US005605295A

United States Patent [19]

Klee

[11] Patent Number: 5,605,295

[45] Date of Patent: Feb. 25, 1997

[54] METHOD AND DEVICE FOR WINDING A YARN

[75] Inventor: Werner Klee, Winterthur, Switzerland

[73] Assignee: Maschinenfabrik Rieter AG, Winterthur, Switzerland

[21] Appl. No.: 256,460

[22] PCT Filed: Nov. 11, 1993

[86] PCT No.: PCT/CH93/00255

§ 371 Date: Sep. 7, 1994

§ 102(e) Date: Sep. 7, 1994

[87] PCT Pub. No.: WO94/11290

PCT Pub. Date: May 26, 1994

[30] Foreign Application Priority Data

Nov. 13, 1992 [CH] Switzerland ..... 3-511/92

[51] Int. Cl.[6] ..... B65H 54/38; B65H 54/28

[52] U.S. Cl. ..... 242/18.1; 242/43 R

[58] Field of Search ..... 242/18.1, 43 R, 242/18 DD, 18 R

[56] References Cited

U.S. PATENT DOCUMENTS

| | | | |
|---|---|---|---|
| 4,049,211 | 9/1977 | Spescha . | |
| 4,394,986 | 7/1983 | Hasegawa et al. . | |
| 4,515,320 | 5/1985 | Slavik et al. . | |
| 4,548,366 | 10/1985 | Wirz et al. | 242/18 DD |
| 4,566,642 | 1/1986 | Sommer et al. . | |
| 4,676,441 | 6/1987 | Maag | 242/18.1 |
| 4,697,753 | 10/1987 | Schippers et al. | 242/18.1 |
| 4,771,961 | 9/1988 | Sugioka | 242/18.1 |
| 4,779,813 | 10/1988 | Sugioka et al. | 242/18.1 |
| 4,789,112 | 12/1988 | Schippers et al. | 242/18.1 X |
| 4,798,347 | 1/1989 | Schippers et al. | 242/18.1 X |
| 5,056,724 | 10/1991 | Prodi et al. | 242/18.1 |
| 5,462,239 | 10/1995 | Klee et al. | 242/18 R |

FOREIGN PATENT DOCUMENTS

| | | |
|---|---|---|
| 0195325 | 9/1986 | European Pat. Off. . |
| 0248406 | 12/1987 | European Pat. Off. . |
| 0064579 | 7/1988 | European Pat. Off. . |
| 0375043 | 6/1990 | European Pat. Off. . |
| 3332382 | 3/1984 | Germany . |

*Primary Examiner*—Michael R. Mansen

*Attorney, Agent, or Firm*—Burns, Doane, Swecker & Mathis, LLP

[57] ABSTRACT

In application of the stepped precision winding process for winding, the rotational speed of a traverse motor is derived directly from the rotational speed of the bobbin chuck. The rotational speed is derived, preferably, using the instantaneously valid winding ratio which, in turn, is determined in relation to the crossing angle.

15 Claims, 5 Drawing Sheets

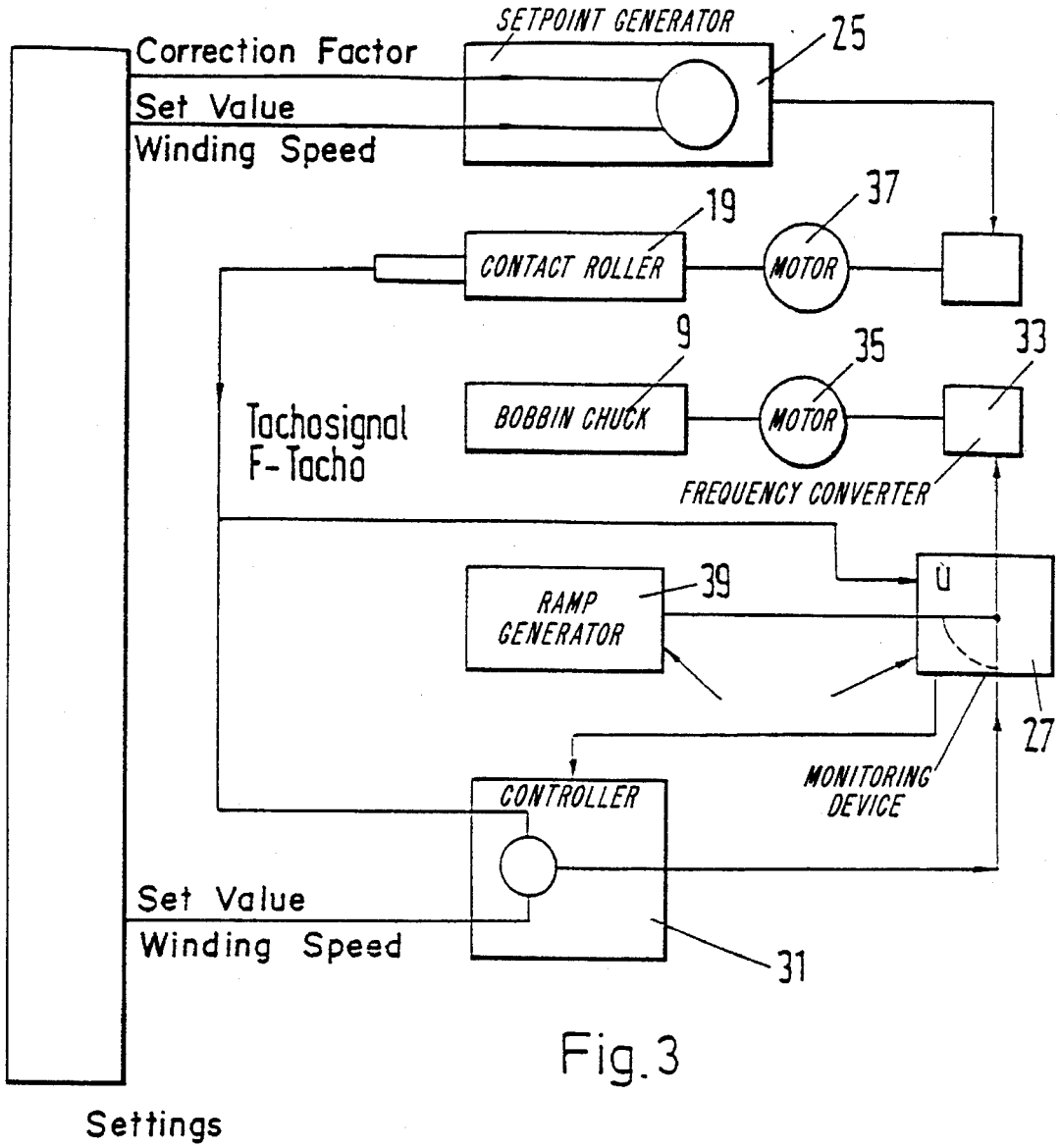
Fig. 3
Fig. 4
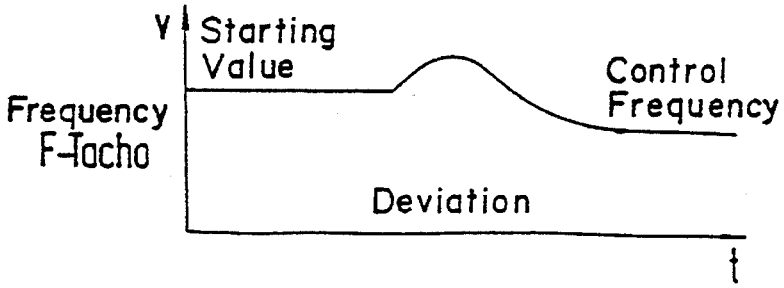

METHOD AND DEVICE FOR WINDING A YARN

FIELD OF THE INVENTION

The invention concerns a method and a device for winding yarns on to a tube by means of the so-called stepped precision winding principle.

BACKGROUND OF THE INVENTION

DOS 3332382 demonstrates a winding device designed for building a bobbin by means of the stepped precision winding process. In particular, this DOS proposes the input of winding ratios into a memory which are then retrieved as required during the bobbin travel. A "step" from one winding ratio to another is initiated in relation to the determined ACTUAL value of the crossing angle of the bobbin—see FIG. 3 of the DOS document.

EP-C-64579 demonstrates another machine which is suitable for winding according to the stepped precision winding process. The winding ratios are again stored in memory as (M/N number pairs). In this case the steps are tripped in relation to the diameter of the bobbin (see FIGS. 7 to 9 and the corresponding description on page 7 of the EP Patent Specification).

SUMMARY OF THE INVENTION

The invention proposes, as a first aspect, a method for building a package with a stepped precision winding system, whereby the winding ratio is changed when the crossing angle assumes a predetermined value, characterized in that the crossing angle is determined by comparison of circumferential speed of the package with a value derived from rotational speed of the package.

The invention proposes, as a second aspect, a method for building a package with a stepped precision winding system characterized in that a signal for controlling the traverse is obtained by the adaptation of a chuck rotation signal in relation to a predetermined winding ratio, whereby the predetermined winding ratio is determined in relation to the instantaneously determined crossing angle.

BRIEF DESCRIPTION OF THE DRAWING FIGURES

The invention is described in greater detail with reference embodiments as examples.

FIG. 1 shows a view of a winder, at the bobbin side,

FIG. 2 shows a cross-section through the contact roller and the bobbin chuck at the start of winding, in accordance with our EP Patent 200234, FIG. 3 shows an example of a possible circuit arrangement for activating a means for regulating the rotational speed of the bobbin chuck, similar to FIG. 6 of U.S. Pat. No. 5,462,239 of 23.07.1992, FIG. 4 shows a representation of the frequency curve of the contact roller following activation by "detuning" of the contact roller frequency by the bobbin, similar to FIG. 7 of U.S. Pat. No. 5,462,239, FIG. 5 shows a schematic representation of the signal connection between the bobbin chuck and the traverse of the machine according to this invention, FIG. 6 is a diagram illustrating the application of the stepped precision winding process according to this invention, FIG. 7 shows a schematic representation of further details of the arrangement as in FIG. 5, FIG. 8 is a diagram illustrating the crossing angle progression.

DETAILED DESCRIPTION OF THE INVENTION

Figure 1:
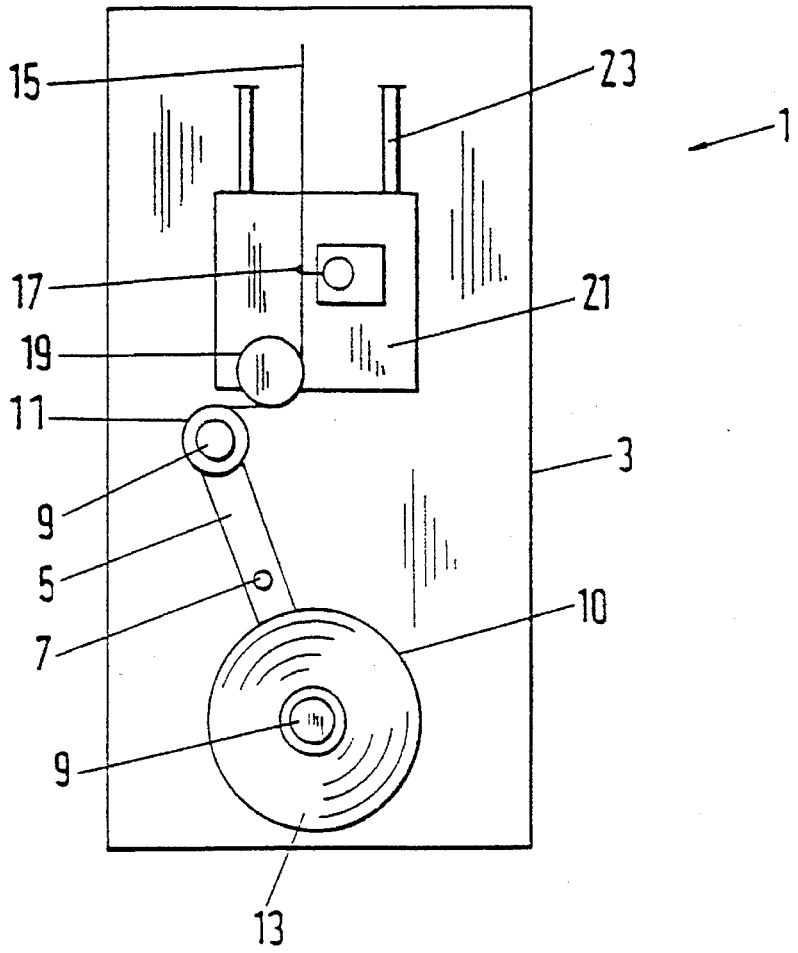
Fig.1 PRIOR ART

In FIG. 1, Ref. 1 indicates a high-speed winder for, in particular, synthetic filaments. For the purpose of simplifying the description only one yarn path is shown. In practice, on machines of this type up to eight bobbins are arranged adjacent to each other on each chuck. The construction of the machine 1 is that known in the art, such as that described for example in the above-mentioned European Patent Specification No. 0200234.

Figure 2:
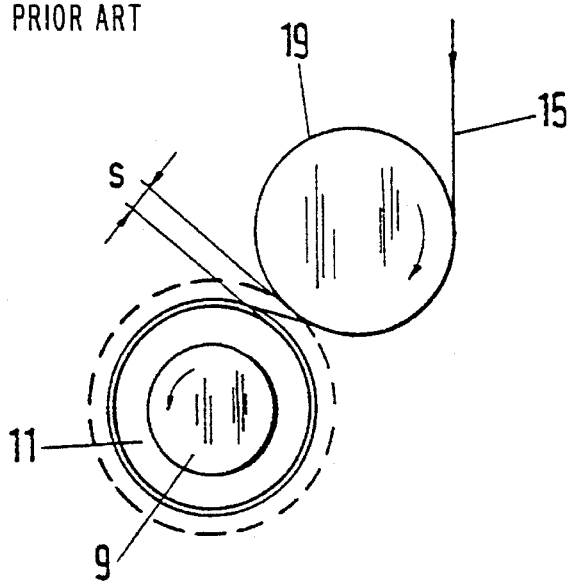
Fig.2 PRIOR ART

For the same reason of simplification, only the elements which are essential to the description of the invention are shown in the figure. Ref. 3 is the casing of the machine 1. A revolver 5, which swivels around an axis 7, carries a chuck 9 at each end, a tube 11 being mounted on each chuck. The lower chuck 9 is shown with the package 10 of a full bobbin 13; only a very small quantity of yarn has been wound on to the upper tube 11, this yarn being scarcely visible in FIG. 1. The yarn 15 which runs from the top is passed backwards and forwards by a traverse device 17, passing around a tacho or contact roller 19 before reaching the tube 11. FIGS. 1 and 2 show, at the start of the winding process, a gap "S" between the contact roller 19 and the surface of the tube 11. Following winding of a certain quantity of yarn on to the tube 11, this gap is closed up and then disappears. The size of the gap "S" is preset and depends upon the rotational speed of the contact roller 19 and, consequently, the winding speed of the machine as well as the yarn count and other characteristics of the yarn 15 which is to be wound.

The gap "S" is not material to this invention but it must nevertheless be taken into account, where such a gap exists, because control of the winding process according to the preferred design can only occur following contact between the package and the contact roller.

The contact roller 19 and the traverse device 17 are mounted in a cantilever bracket 21 which is moved vertically by the guide 23.

The initial winding of the yarn 15 on to the tube 11 without contact with the contact roller 19 has the advantage that there is no resultant "milling" and rubbing of the contact roller 19 and the tube 11 and therefore there can be no damage to the outer layers of the yarn 15 wound on to the tube 11. The time until the gap "S" is filled is determined by means of a previously calculated rotational speed ramp, i.e., a rotational speed progression which reduces the rotational speed of the bobbin chuck 9 as the diameter of the bobbin package 13 increases, to a point at which the two surface speeds are theoretically identical—when the gap "S" is filled and there is contact between the two surfaces. This, however, is only theoretically possible, due to a wide variety of parameters, such as the quality of the yarn 15, the yarn count, etc.

The automatic software control process for changing the speed ramp using detuning is illustrated and explained with reference to a possible "circuit" as in FIG. 3. In practice, this "circuit" is "embodied" in the software of the machine control system.

At the start, the setpoint generator 25 receives setting values for the contact roller 19, for both a winding speed VTW and a correction factor which controls the circumferential force, as described, for example, in EP-A-182389. Since an asynchronous motor is used as the contact roller drive motor 37, the contact signal (frequency F tacho) differs from the contact setpoint. However, the absolute value of the frequency (F tacho) is not significant for monitoring by the monitoring device 27. Following a time delay such that the contact roller 19 rotates at the starting speed, the chuck drive motor 35 is switched on by the control system and likewise brought to the starting speed, at which point the yarn can be drawn in.

When the yarn is drawn in, the monitoring device 27 switches on the ramp generator 39 which delivers its output frequency to the frequency converter 33. The device 27, and the ramp signal generator 39, which determines the rotational speed progression of the bobbin chuck 9, each separately receive a signal when the yarn is drawn in. The controller 31 is deactivated at this point, since the contact signal (F tacho) cannot be used for servo control.

Following contact by one or more bobbin packages with the contact roller 19, the contact frequency deviates from its starting value. This deviation is detected by the monitoring device 27 which then switches off the ramp generator 39 and activates the controller 31. The controller 31 then brings the chuck speed VTW back to a value which produces a predetermined control frequency (the control frequency being in conformity with the set value for the bobbin speed).

The deviation from the starting value must attain a magnitude such that an essentially slip-free frictional connection is established between the surfaces of the contact roller 19 and the package 10 on the bobbin 11. Minor disturbance effects can be disregarded. It is also possible to build in a time delay after the detection of the deviation for the purpose of ensuring that the conditions for the essentially slip-free frictional connection between the surfaces of the contact roller 19 and the bobbin package 10 have been fulfilled so that an unambiguous measurement value is obtained from the contact signal for the actual bobbin speed VDO.

The deviation from the starting value can occur as described above (FIG. 4) or as described below (no figure). The control frequency can be above or below the starting frequency, or it can be equal to the starting frequency.

The following description assumes that the gap has been filled up, or is not present at the start of the bobbin building process. In the latter case, contact between the contact roller and the package exists from the start.

Figure 5:
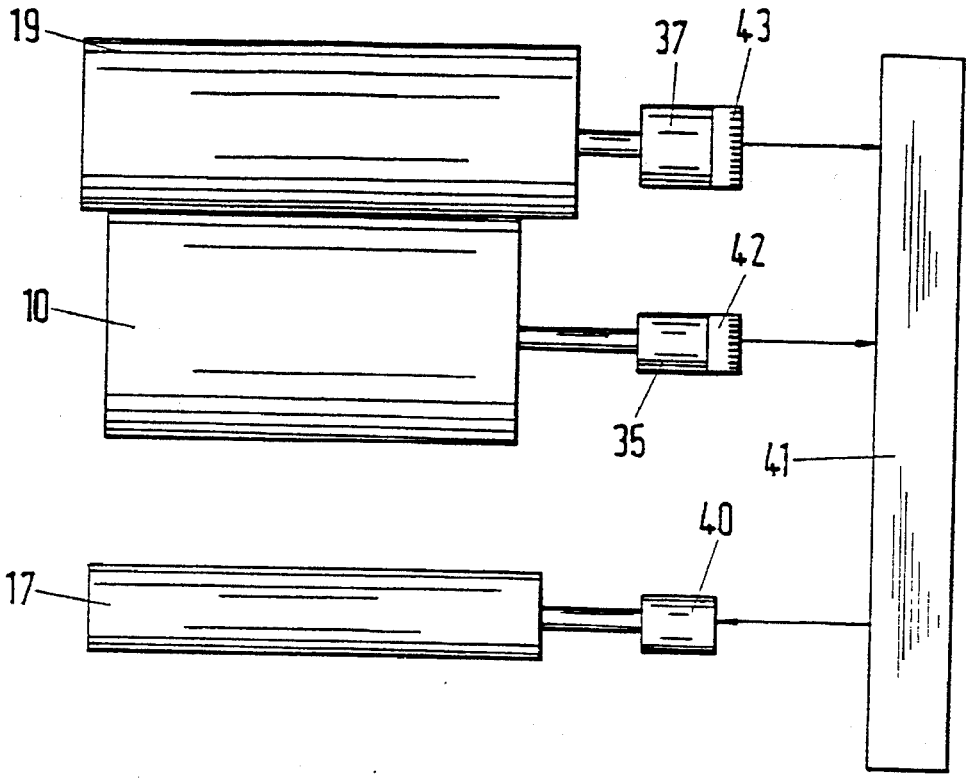

FIG. 5 shows, in schematic form, further details of the drives for the different fundamental components of the machine. These components comprise:

the contact or tacho roller 19 with its drive motor 37, the bobbin chuck (not shown in FIG. 5) in the winding position, with the package 10 and its drive motor 35, and the traverse device 17 with its drive motor 40.

Ref. 41 designates the machine control system as a complete unit. The representation in FIG. 5 bears no relation to the geometry of the actual layout of the machine (FIG. 1) since FIG. 5 serves to illustrate signal connections rather than the spatial form of the machine.

The motor 35 and the motor 37 are each equipped with a tacho signal generator, 42 and 43 respectively, which generates a signal which represents the rotational speed of the motor or the speed of the axle driven by the motor. These signals are delivered to the control system 41. The control system 41 generates a signal which is supplied to the motor 40 (or to a controller, not illustrated, for the motor 40) for the purpose of determining the rotational speed of this motor. This determines the movement of the yarn guide or guides.

Figure 6:
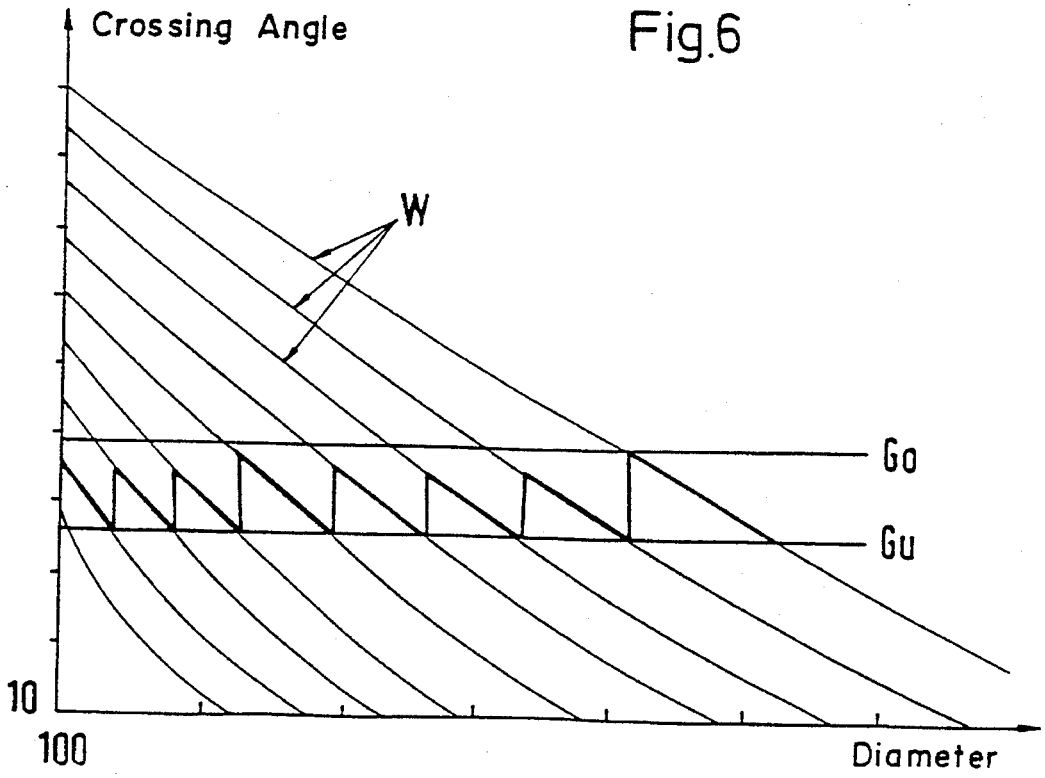

The theory of stepped precision winding, as embodied here, has been explained in DOS 3332382 and is not repeated in this document. The effect is summarized in FIG. 6. The horizontal axis of the diagram gives the bobbin diameter (the axis does not start from "zero" because a "bobbin travel" commences at a minimal bobbin diameter which is given by the diameter of the empty tube 11, FIG. 1). The vertical axis gives the bobbin crossing angle.

It is a characteristic of a precision winding system that the crossing angle decreases as the bobbin diameter increases if the winding ratio (the number of forward-and-back cycles of the yarn guide per bobbin rotation) remains constantly unchanged. Curves for constant winding ratios are indicated by W.

In a stepped precision winding system, "steps" from a higher winding ratio (curve closer to the left-hand corner of the diagram) to a lower winding ratio (curve further from the left-hand corner) occur at given points during the bobbin travel.

According to the proposed method, such a step occurs when the crossing angle, in the prevailing winding ratio, drops to a lower limiting value Gu. The magnitude of the step is limited by an upper limiting value Go, which prevents unwanted sudden changes in the bobbin ratios. However, this maximum step magnitude cannot be used without qualification because the "valid" winding ratios have to be input to the memory of the control system 41 as single values. Since only a finite number of such winding ratios can be stored in the memory, an "existing" value within the limits Gu-Go must be selected from the memory and applied for a step.

The winding ratios must be precisely determined, to at least four (preferably five) decimal places. In the case of very high delivery speeds (bobbin circumferential speeds), building of the bobbin can be impaired by time lags in the execution of these steps. It is necessary to avoid, as far as possible, any time lag in the determination of a new winding ratio in the control system 41 and any inaccuracy in the execution of a step.

Known in the art is the practice of controlling the traverse speed for the purpose of obtaining a predetermined winding ratio from the control system 41. The traverse speed must be continuously adjusted because the rotation speed of the chuck is reduced as the bobbin diameter increases in order to keep the circumferential speed of the bobbin constant.

Figure 7:
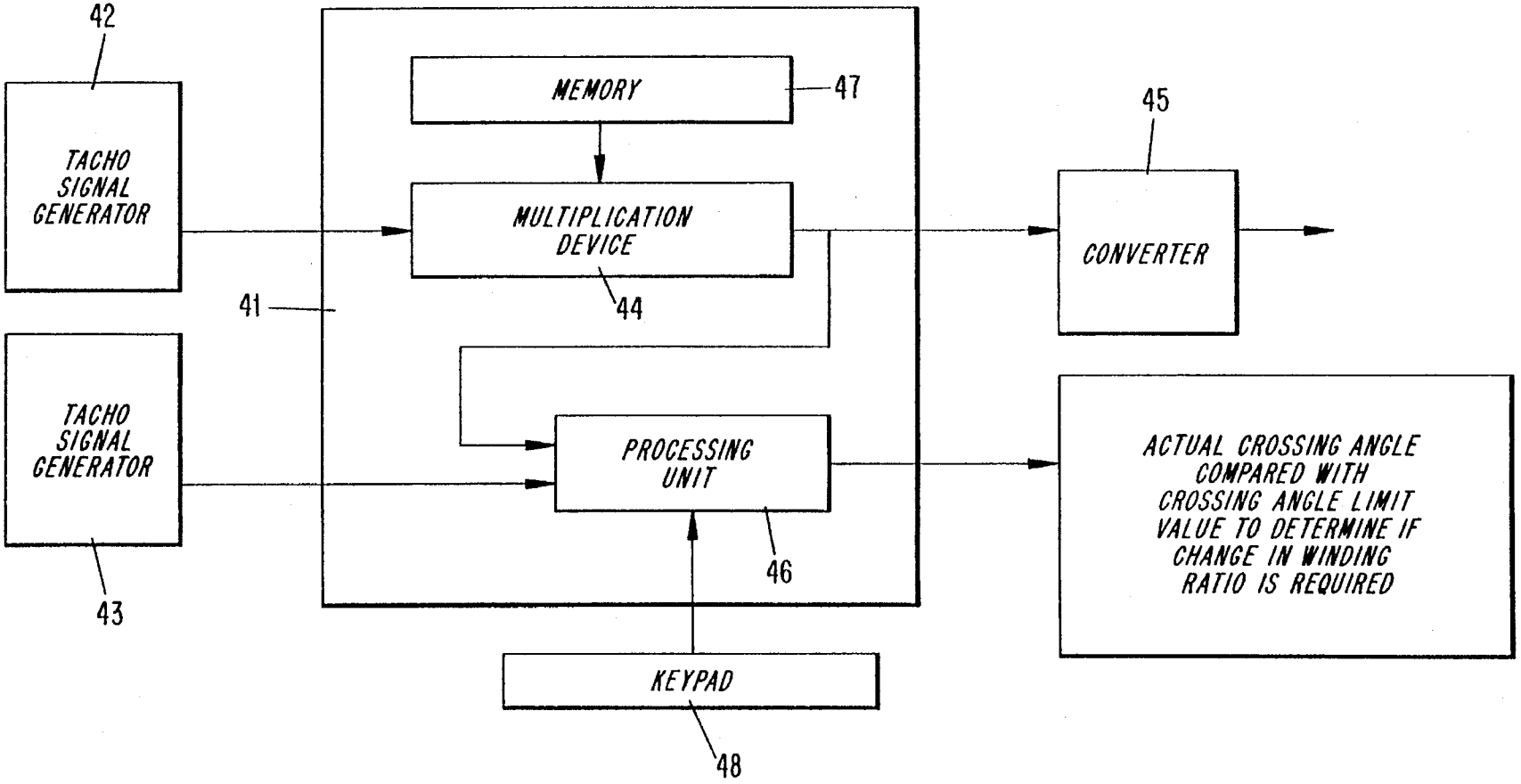

In the design as in FIG. 7, the traverse speed is corrected in dependence upon to the rotational speed of the chuck, with a feed frequency for a frequency-controlled drive motor 40 (FIG. 5) being derived directly from the output signal of the generator 42 (FIG. 5). For this purpose, the control system 41 comprises a multiplication device 44 by means of which the frequency generated by the generator 42 is multiplied by a factor "X". The output signal of the device 44 is transferred to a frequency converter 45 as a control signal and determines the output signal of the power section of the converter 45. The latter output signal is delivered to the motor 40 (FIG. 5) as a feed frequency and determines the rotational speed of this motor. The motor 40 can be, for example, a synchronous motor.

The use of a synchronous motor, or even a frequency-controlled motor as a traverse drive motor 40 is not a material characteristic of the invention, since it would be possible to use any other precisely controllable motor capable of producing the required power. The control system 41 would then have to produce a control signal suitable for the motor controller.

The factor X corresponds to the prevailing winding ratio. In a "step", the prevailing factor must be replaced by a new factor which has to be retrieved from the above-mentioned memory 47 and input to the device. The replacement of one factor by a new factor can be executed rapidly and is effective almost immediately for determination of the output frequency of the converter 45.

The initiation of a step is important in this connection and here again time lags are to be avoided as far as possible. A new factor must be selected when the crossing angle falls to a predetermined value, which must be monitored. The motor 40 could also be equipped with a tacho signal generator for this purpose, which would be the same as measuring the crossing angle (cf. DOS 3332382). This, however, necessitates an additional signal generator and additional signal processing capacity in the control system 41. Signals which can be used for determination of the crossing angle are, however, already present, as in FIGS. 3 and 5, these being the output signal of the device 44 (corresponding to the traverse speed) and the output signal of the tacho signal generator 43 (corresponding to the circumferential speed of the bobbin). The ACTUAL value of the crossing angle is measured by processing these signals in the unit 46 (FIG. 7). The limiting values Go, Gu (FIG. 6) can be entered by the user via a keypad 48 and compared with the ACTUAL value.

Input of a Crossing Angle Progression

Figure 8:
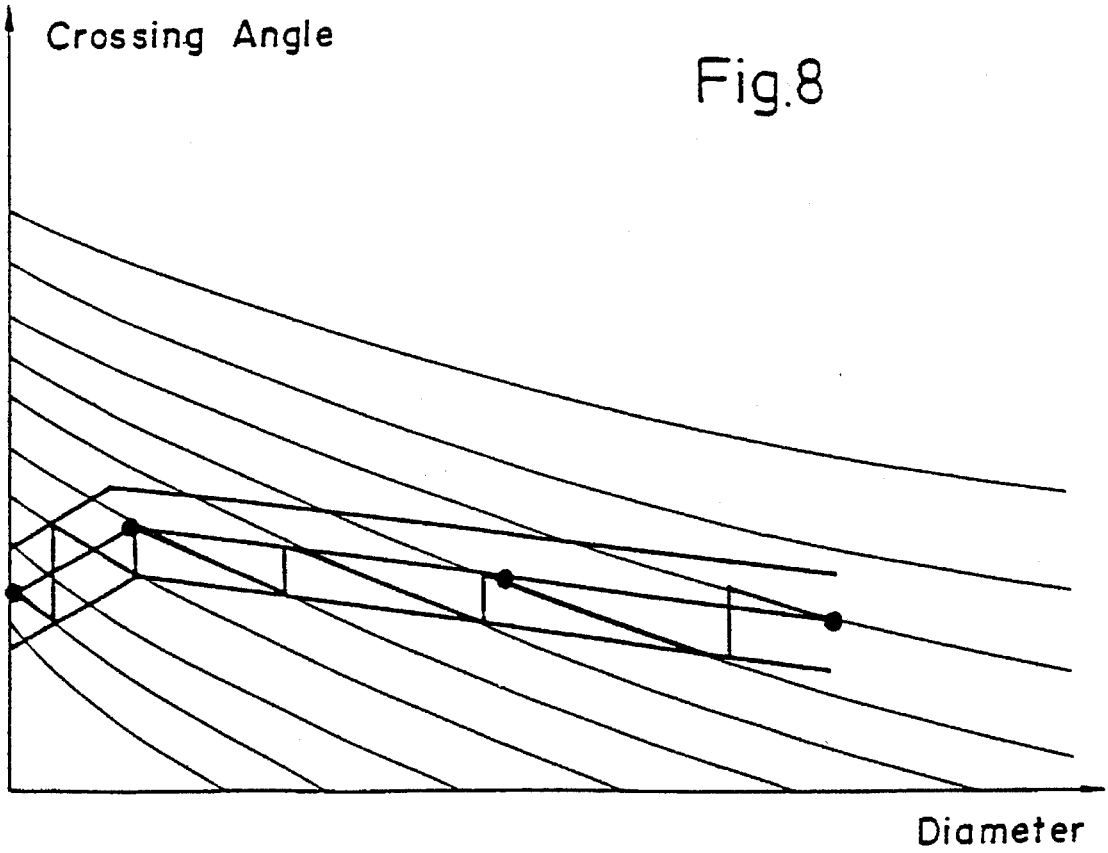

The principle of a preferred embodiment for setting a device according to this invention is shown in schematic form in FIG. 8.

In order to optimize building of the package, the setpoint crossing angle can be determined as a function of the bobbin diameter. The progression of the setpoint curve is determined using four base points SP0, SP1, SP2 and SP3 and the bandwidth B.

The base points are defined as follows:

| | | |
|---|---|---|
| SP 0: Tube diameter (fixed) | /Crossing angle 0 | (example: 106 mm/14°) |
| SP 1: Change point angle 1 | /Crossing angle 1 | (example: 150 mm/15°, 75°) |
| SP 2: Change point angle 2 | /Crossing angle 2 | (example: 250 mm/14°) |
| SP 3: Bobbin diameter | /Crossing angle 3 | (example: 420 mm/14°) |

In this case, where the required crossing angle changes over the bobbin travel, the instantaneously prevailing set value for the crossing angle must be determined by the control system by determination or measurement of the bobbin diameter. This gives an instantaneously valid winding ratio which must then be changed when the effective crossing angle deviates outside the bandwidth.

I claim:

1. A method for building a package with a stepped precision winding system that includes a chuck on which the package is built and a traverse device for moving yarn back and forth with respect to the chuck, comprising:

winding yarn on the chuck to build a package;

determining a chuck rotational speed to obtain a chuck rotational speed signal;

controlling the traverse device based on the chuck rotational speed signal and a set winding ratio;

determining the circumferential speed of the package;

deriving a quantity from the determined chuck rotational speed;

determining a crossing angle at which the yarn is being wound on the package based on the determined circumferential speed of the package and the quantity derived from the determined chuck rotational speed;

comparing the determined crossing angle to a predetermined crossing angle value; and changing the set winding ratio to a different winding ratio when the determined crossing angle reaches the predetermined crossing angle value.

2. A method according to claim 1, wherein said step of deriving a quantity includes deriving a quantity based on both the chuck rotational speed and the predetermined winding ratio.

3. A method according to claim 1, including utilizing said chuck rotational speed signal for controlling the traverse and for determining the crossing angle.

4. A method according to claim 1, including entering said predetermined crossing angle value by way of a keyboard.

5. A method according to claim 1, wherein said predetermined crossing angle value is a lower limit value for the crossing angle, and including entering by way of a keyboard said lower limit value for the crossing angle and an upper limit value for the crossing angle, said step of comparing the determined crossing angle to the predetermined crossing angle value including comparing the determined crossing angle value to at least the lower limit value.

6. A winding device for winding yarn to build a package, comprising:

a chuck on which is to be built a package;

a chuck drive device for rotating the chuck;

a traverse device for moving the yarn back and forth with respect to the chuck;

a traverse drive device for moving the traverse device;

a signal generator for generating a first signal corresponding to the rotational speed of the chuck;

means for determining a circumferential speed of the package; and a control system adapted to generate a second signal based on said first signal, said second signal being used to control movement of the traverse device, said control system including means for deriving a crossing angle of the yarn being wound based on the determined circumferential speed of the package and a quantity derived from the rotational speed of the chuck, and for changing a winding ratio when the derived crossing angle reaches a predetermined crossing angle value.

7. A winding device according to claim 6, wherein said means for determining the circumferential speed of the package includes a contact roller with a tacho signal generator.

8. A winding device according to claim 7, wherein the contact roller is driven by a drive motor that is connected to another signal generator.

9. A winding device as in claim 6, wherein said means for deriving a crossing angle of the yarn being wound determines the quantity derived from the rotational speed of the chuck using a prevailing winding ratio which is predetermined by the control system.

10. A winding device according to claim 6, including means for entering and changing the predetermined crossing angle value.

11. A winding device according to claim 6, wherein said predetermined crossing angle value is a lower limit value for the crossing angle, and including means for entering and changing the lower limit value for the crossing angle and an upper limit value for the crossing angle.

12. A method of building a package with a stepped precision winding system having a plurality of stored winding ratios in which yarn is wound with respect to a chuck to produce a package while a crossing angle of the yarn changes, comprising:

entering upper and lower limit values for the crossing angle to define a desired crossing angle range;

selecting a winding ratio;

winding yarn onto a tube under the selected winding ratio;

determining an actual crossing angle of the yarn being wound;

selecting a different winding ratio when the determined actual crossing angle reaches one of said upper and lower limit values so that winding of the yarn continues under a new winding ratio, said new winding ratio being selected so that the crossing angle of the yarn is within said desired crossing angle range.

13. A method according to claim 12, including determining a rotational speed of the chuck and determining a circumferential speed of the package, determining a quantity derived from the determined rotational speed of the chuck, said actual crossing angle being determined based on the determined circumferential speed of the package and the quantity derived from the determined rotational speed of the chuck.

14. A method according to claim 12, including manually entering said upper and lower limit values for the crossing angle.

15. A method according to claim 13, including traversing the yarn back and forth with respect to the chuck by way of a traverse device, and including controlling the traverse device based on the selected winding ratio and the determined rotational speed of the chuck.

* * * * *